US008680839B2

(12) United States Patent
Venkiteswaran S. et al.

(10) Patent No.: US 8,680,839 B2
(45) Date of Patent: Mar. 25, 2014

(54) OFFSET CALIBRATION TECHNIQUE TO IMPROVE PERFORMANCE OF BAND-GAP VOLTAGE REFERENCE

(75) Inventors: Mahadevan Venkiteswaran S., Karnataka (IN); Subramanian J. Narayan, Karnataka (IN); Vadim Ivanov, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 249 days.

(21) Appl. No.: 13/233,290

(22) Filed: Sep. 15, 2011

(65) Prior Publication Data

US 2013/0069616 A1 Mar. 21, 2013

(51) Int. Cl.
*G05F 1/613* (2006.01)
*G05F 1/618* (2006.01)

(52) U.S. Cl.
USPC ..... 323/311; 327/538

(58) Field of Classification Search
USPC ..... 323/297, 311–314, 317, 354; 327/538–540
See application file for complete search history.

(56) References Cited

U.S. PATENT DOCUMENTS 6,215,353 B1 * 4/2001 Lewyn ..... 327/538
6,628,169 B2 * 9/2003 Ivanov et al. ..... 330/256
7,274,250 B2 * 9/2007 Hazucha et al. ..... 327/539
7,411,443 B2 * 8/2008 Ivanov et al. ..... 327/539
7,633,280 B2 * 12/2009 Ivanov et al. ..... 323/316
7,880,534 B2 * 2/2011 Huang et al. ..... 327/539
8,222,881 B2 * 7/2012 Ivanov et al. ..... 323/288
8,513,938 B2 * 8/2013 Tachibana et al. ..... 323/315
2006/0220634 A1 * 10/2006 Ito et al. ..... 323/313
2010/0295529 A1 * 11/2010 Consoer ..... 323/313

* cited by examiner

*Primary Examiner* — Adolf Berhane
*Assistant Examiner* — Nusrat Quddus
(74) *Attorney, Agent, or Firm* — Ronald O. Neerings; Wade James Brady; Frederick J. Telecky, Jr.

(57) ABSTRACT

Offset calibration technique to improve performance of band gap voltage reference. An example of a bandgap reference source includes an output resistor, a first and second transistors and a differential amplifier. A positive-input calibration phase switch is in communication with a positive amplifier input, a emitter of the first and second transistor and a negative-input calibration phase switch in communication with the negative amplifier input, the emitter of the first and second transistor. A positive-output calibration phase switch is in communication with the positive amplifier output, the first and second terminal of the output resistor and a negative-output calibration phase switch is in communication with the negative amplifier output, the first and second terminal of the output resistor. An adjustable resistance is in communication with the emitter of the first transistor, the emitter of the second transistor, and the second terminal of the output resistor.

15 Claims, 3 Drawing Sheets

OFFSET CALIBRATION TECHNIQUE TO IMPROVE PERFORMANCE OF BAND-GAP VOLTAGE REFERENCE

TECHNICAL FIELD

Embodiments of the present disclosure relates to an offset calibration technique for improving performance of band gap voltage reference.

BACKGROUND

A "band-gap reference" is a voltage source that provides a highly constant level of voltage. The voltage level produced by a band-gap reference is related to the quantum physics of the semiconductor out of which it is constructed. The band-gap reference is required to not only have high accuracy but also stability under temperature change.

An exemplary circuit of band gap reference 100 for generating band gap voltage ($V_{BG}$) is illustrated in FIG. 1 (Prior Art). The circuit 100 generates a band-gap voltage that is given by the following equation:

$$V_{BG} = V_{BE} + \left(\frac{2R_2 + R_1}{R_0}\right)\Delta V_{BE} + \left(\frac{2R_2 + R_1}{R_0}\right)V_{OFF} \quad (1)$$

where, $$VBGSlope = V_{BE} + \left(\frac{2R_2 + R_1}{R_0}\right)\Delta V_{BE},$$

$$VOFFSET = \left(\frac{2R_2 + R_1}{R_0}\right)V_{OFF}$$

$V_{BE}$ is a base-to-emitter voltage of one of the PNP transistors 103, and it has a negative temperature co-efficient, that is, it decreases as temperature increases $\Delta V_{BE}$ is the difference of the base-to-emitter voltages of the two PNP transistors (101 and 103), and is a positive quantity with a positive temperature coefficient. It can also be derived using $\Delta V_{BE}$=cT ln r, where c is a constant of proportionality, T is the absolute temperature in degrees Kelvin, and r is the ratio of the collector current densities of the two PNP transistors (101 and 103). Thus we see that $\Delta V_{BE}$ equals zero at 0 K, and increases linearly with temperature.

Here, the principle is to balance the decrease with temperature of $V_{BE}$ with the increase with temperature of $\Delta V_{BE}$ so that $V_{BG}$, which is a weighted sum of $V_{BE}$ and $\Delta V_{BE}$, remains constant at all temperatures. Now the rate at which $V_{BE}$ decreases with temperature is not equal to and generally much larger than the rate at which $\Delta V_{BE}$ increases with temperature. Hence in equation (1) $\Delta V_{BE}$ is weighted by a large positive number. The weight for $\Delta V_{BE}$ in equation (1) is the weighted sum of two resistors ($R_1$, which is the common value of resistors 109 and 111, and $R_2$, which is the value of the resistor 117, and divided by $R_0$, which is the value of the resistor 107) whose values may be trimmed in order to achieve a temperature-stable $V_{BG}$. There is one more term, $$\left(\frac{2R_2 + R_1}{R_0}\right)V_{OFF}$$

in equation (1), which is traceable to a non-ideal offset voltage $V_{OFF}$ generated by the error-amplifier 105.

In summary, the voltage generated by the circuit 100 may be represented as $V_{BG}$=VBGSlope+VOFFSET, where the first term, VBGSlope, may vary with temperature, and needs to be set to constancy by trimming the circuit, and the second term, VOFFSET appears as a constant offset and needs to be set to zero by trimming the circuit.

During silicon testing or validation stage of chip manufacture, the resistors of the circuit 100 can be trimmed (adjusted) so that there is minimal dependence of $V_{BG}$ with temperature, and so that $V_{BG}$ has no offset that renders it inaccurate. Typically the process of trimming the circuit 100 implies the measurement of VOFFSET and VBGSlope at two different temperatures to obtain high accuracies. This process is known as two-temperature trim. The oven in which the circuit-to-be-trimmed that is being calibrated needs several minutes to reach a certain temperature. Hence two-temperature trim is a process that generally takes several minutes. It is a time-intensive process to implement two-temperature trim for multiple circuits.

Other existing methods for trimming the circuit 100 require the presence of a clock, which sometimes itself needs the presence of a band-gap reference and consume more area on the chip.

Hence, it is desirable to have an offset calibration technique for improving band gap performance.

SUMMARY

An example of a bandgap reference voltage source includes an output resistor, a first and second transistors having collectors connected to a common return and bases connected to a first terminal of the output resistor, a differential amplifier having a positive input, a negative input, a positive output and a negative output used in single ended configuration. The bandgap reference voltage source also includes a positive-input calibration phase switch in communication with the positive amplifier input, a emitter of the first transistor, and the resistor connected to the emitter of the second transistor, a negative-input calibration phase switch in communication with the negative amplifier input, the emitter of the first transistor, and the resistor connected to the emitter of the second transistor, a positive-output calibration phase switch in communication with the positive amplifier output, the first terminal of the output resistor, and a second terminal of the output resistor and a negative-output calibration phase switch in communication with the negative amplifier output, the first terminal of the output resistor, and the second terminal of the output resistor. Further, the bandgap reference voltage source includes an adjustable resistance in communication with the emitter of the first transistor, the emitter of the second transistor, and the second terminal of the output resistor.

An example of a method of calibrating a bandgap reference voltage source having a positive-input calibration phase switch that in a first phase establishes a connection between a positive amplifier input and a emitter of a first transistor and in a second phase establishes a connection between the positive amplifier input and a resistor connected to the emitter of a second transistor, a negative-input calibration phase switch that in the first phase establishes a connection between a negative amplifier input and the emitter of the second transistor through the resistor and in the second phase establishes a connection between the negative amplifier input and the emitter of the first transistor, a positive-output calibration phase switch that in the first phase establishes a connection between a positive amplifier output and a second terminal of an output resistor and in the second phase establishes a connection between the positive amplifier output and a first terminal of the output resistor and a negative-output calibration phase switch that in the first phase establishes a connection between a negative amplifier output and the first terminal of an output resistor and in the second phase establishes a connection between the negative amplifier output and the second terminal of the output resistor includes setting the calibration phase switches to the first phase. The method also includes measuring a first-phase output voltage developed across the output resistor, setting the calibration phase switches to the second phase, measuring a second-phase output voltage developed across the output resistor, setting the calibration phase switches to the first phase, adjusting a first trim resistor in series with the emitter of the first transistor and a second trim resistor in series with the emitter of the second transistor according to the first-phase and second-phase output voltages and adjusting the output resistor until the output voltage attains a desired value.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the disclosure.

DETAILED DESCRIPTION OF THE EMBODIMENTS

It should be observed that method steps and system components have been represented by conventional symbols in the figures, showing only specific details that are relevant for an understanding of the present disclosure. Further, details that may be readily apparent to person ordinarily skilled in the art may not have been disclosed. In the present disclosure, relational terms such as first and second, and the like, may be used to distinguish one entity from another entity, without necessarily implying any actual relationship or order between such entities.

Various embodiments discussed in this disclosure pertain to an offset calibration technique for improving performance of a band gap voltage reference.

Figure 1:
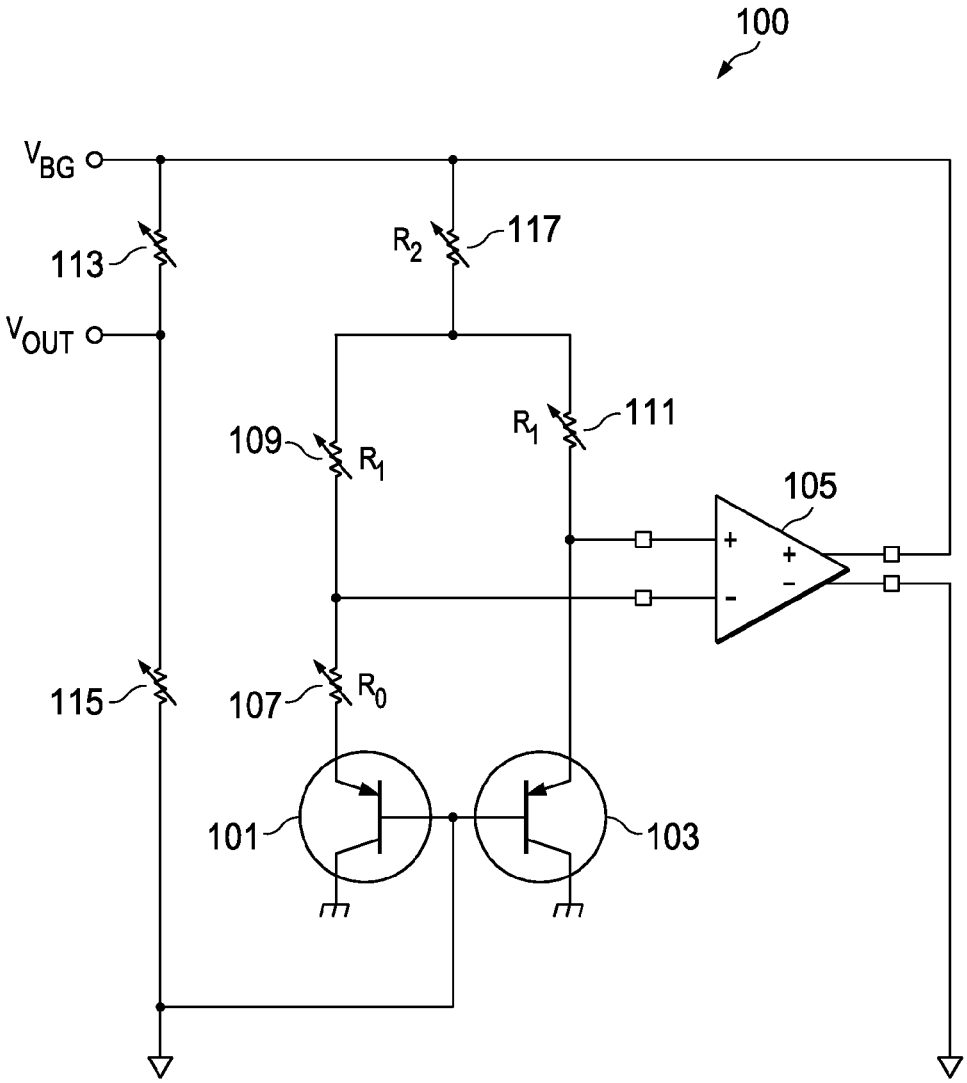
FIG. 1 (PRIOR ART)
FIG. 1 is a band gap reference circuit, in accordance with a prior art.
Figure 2:
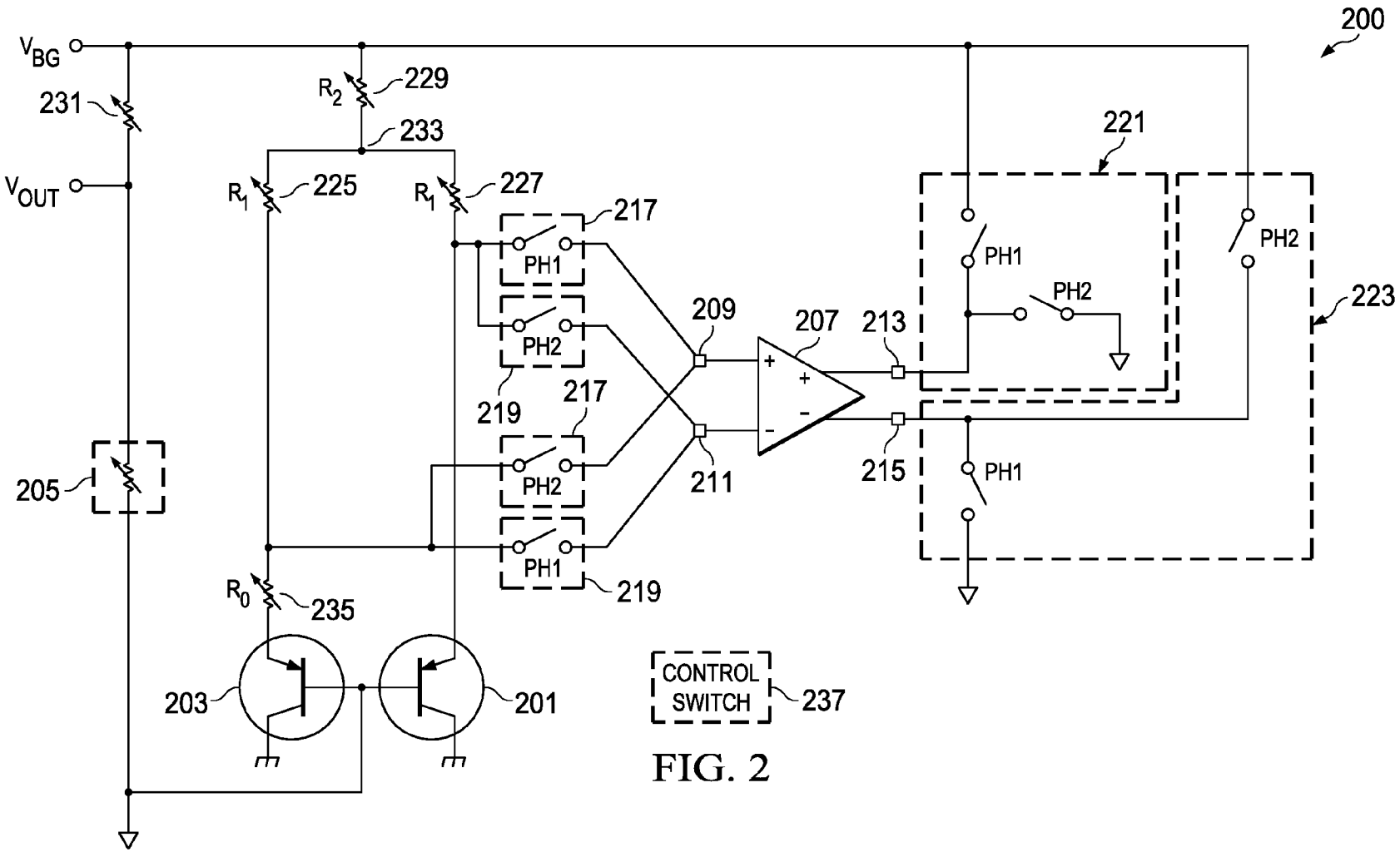
FIG. 2 is a band gap reference source, in accordance with an embodiment.

FIG. 2 illustrates a bandgap reference voltage source 200. The bandgap reference voltage source 200 includes a first transistor 201 and a second transistor 203. The collectors of the first and the second transistor (201 and 203) are connected to a common return and bases connected to a first terminal of an output resistor 205. The first and the second transistor (201 and 203) can be bipolar PNP transistors.

The bandgap reference voltage source 200 also includes a differential amplifier 207 having a positive input 209, a negative input 211, a positive output 213 and a negative output 215. The differential amplifier 207 can be represented a fully differential amplifier. A positive-input calibration phase switch 217 is in communication with the positive input 209, an emitter of the first transistor 201, and an emitter of the second transistor 203. A negative-input calibration phase switch 219 is in communication with the negative input 211, the emitter of the first transistor 201, and the emitter of the second transistor 203. A positive-output calibration phase switch 221 is in communication with the positive amplifier output 213. A negative-output calibration phase switch 223 is in communication with the negative output 215.

The bandgap reference voltage source 200 includes an adjustable resistance. The adjustable resistance includes four trim resistors (225, 227, 229 and 231). First terminals of each of the first three trim resistors (225, 227 and 229) connected to a common node 233, a second terminal of the first trim resistor 225 is in communication with the emitter of the second transistor 203 through a balancing resistor 235, a second terminal of the second trim resistor 227 is in communication with the emitter of the first transistor 201, a second terminal of the third trim resistor 229 connected to a first terminal of the fourth trim resistor 231, and a second terminal of the fourth trim resistor 231 is connected to the second terminal of the output resistor 205 to define an output ($V_{OUT}$). Further, the positive-output calibration phase switch 221 is also in communication with the first terminal of the fourth trim resistor 231, the second terminal of the third trim resistor 229 and the common return. The negative-output calibration phase switch 223 is also in communication with the first terminal of the fourth trim resistor 231, the second terminal of the third trim resistor 229 and the common return.

Each of the positive-input calibration phase switch 217, the negative-input calibration phase switch 219, the positive-output calibration phase switch 221 and the negative-output calibration phase switch 223 can be calibrated uniquely in two phases, a first calibration phase (PH1) and a second calibration phase (PH2). Under the first calibration phase, the positive-input calibration phase switch 217 establishes a connection between the positive input 209 and the emitter of the first transistor 201. The negative-input calibration phase switch 219 establishes a connection between the negative input 211 and the emitter of the second transistor 203 through the balancing resistor 235. The positive-output calibration phase switch 221 establishes a connection between the positive output 213, and the second terminal of the third trim resistor 229 and the first terminal of the fourth trim resistor 231. The negative-output calibration phase switch 223 establishes a connection between the negative output 215 and the common return (first terminal of the output resistor 205). Under the second calibration phase, the positive-input calibration phase switch 217 establishes a connection between the positive input 209 and the emitter of the second transistor 203 through the balancing resistor 235, the negative-input calibration phase switch 219 establishes a connection between the negative input 211 and the emitter of the first transistor 201, the positive-output calibration phase switch 221 establishes a connection between the positive output 213 and the common return (first terminal of the output resistor 205), and the negative-output calibration phase switch 223 establishes a connection between the negative output 215, and the second terminal of the third trim resistor 229 and the first terminal of the fourth trim resistor 231. In one embodiment, the bandgap reference voltage source 200 can include a control switch 237 that is operable to switch between the first calibration phase and the second calibration phase.

In some embodiments, the output resistor 205 can include a variable resistor and a fixed resistor in series, and the output being defined at a junction between the variable and fixed resistors. For example, the fourth trim resistor 231 can be the variable resistor and the output resistor 205 can be the fixed resistor and $V_{OUT}$ being defined as the output.

In some embodiments, a second terminal of the second trim resistor 227 is in communication with the emitter of the first transistor 201 through a balancing resistor.

In some embodiments, values of resistance for the resistors can be varied and can be of different values.

In an embodiment, the positive-output calibration phase switch 221 is connected to the emitter of the second transistor 203 through the balancing resistor 235, the first trim resistor 225 and the third trim resistor 227, and the negative-input calibration phase switch 219 is connected to the emitter of the second transistor 203 through the balancing resistor 235 in series with the emitter of the second transistor 203.

$V_{BE}$ is the base-to-emitter voltage of the first transistor 201, and it has a negative temperature co-efficient, that is, it decreases as temperature increases. $\Delta V_{BE}$ is the difference of the base-to-emitter voltages of the first and the second transistor (201 and 203), and is a positive quantity with a positive temperature coefficient. More precisely, it is given as $\Delta V_{BE}=cT \ln r$, where c is a constant of proportionality, T is the absolute temperature in degrees Kelvin, and r is the ratio of the current densities of the first and the second transistor (201 and 203). Thus we see that $\Delta V_{BE}$ equals zero at 0 K, and increases linearly with temperature.

Under the first calibration phase, the Ph1 switches are closed and the Ph2 switches are opened, the output voltage Vout1 will be given by $$V_{OUT1}=VBG\text{Slope}+V\text{OFFSET} \tag{2}$$

Here, $$VBGSlope = V_{BE} + \left(\frac{2R_2 + R_1}{R_0}\right)\Delta V_{BE} \text{ and}$$

$$VOFFSET = \left(\frac{2R_2 + R_1}{R_0}\right)V_{OFF}.$$

Under the second calibration phase, the Ph1 switches is open and Ph2 switches are closed, then the output voltage $V_{OUT2}$ is given by $$V_{OUT2}=VBG\text{Slope}-V\text{OFFSET} \tag{3}$$

Using equation (2) and (3), VBGSlope will be given by the average of $V_{OUT1}$ and $V_{OUT2}$, and VOFFSET will be given by half the difference between $V_{OUT1}$ and $V_{OUT2}$.

In an exemplary case of a band-gap reference constructed from silicon, an ideal value of VBGSlope is given as 1.226 Volts (V) and of VOFFSET is given as 0 (zero) milliVolts (mV) to typically give an output voltage $V_{OUT}$ (in this example say 900 mV). Any deviation from ideal in VBGSlope will be detected upon averaging $V_{OUT1}$ and $V_{OUT2}$, and such deviation can be calibrated away to zero by adjusting the first trim resistor 225 in series with the emitter of the second transistor 203, the second trim resistor 227 in series with the emitter of the first transistor 201, and the third trim resistor 229 according to the first-phase and second-phase output voltages. Any deviation in VOFFSET from zero is calibrated by adjusting the fourth trim resistor 231 until the output voltage $V_{OUT}$ attains a desired value, say 900 milliVolts in a particular application.

Figure 3:
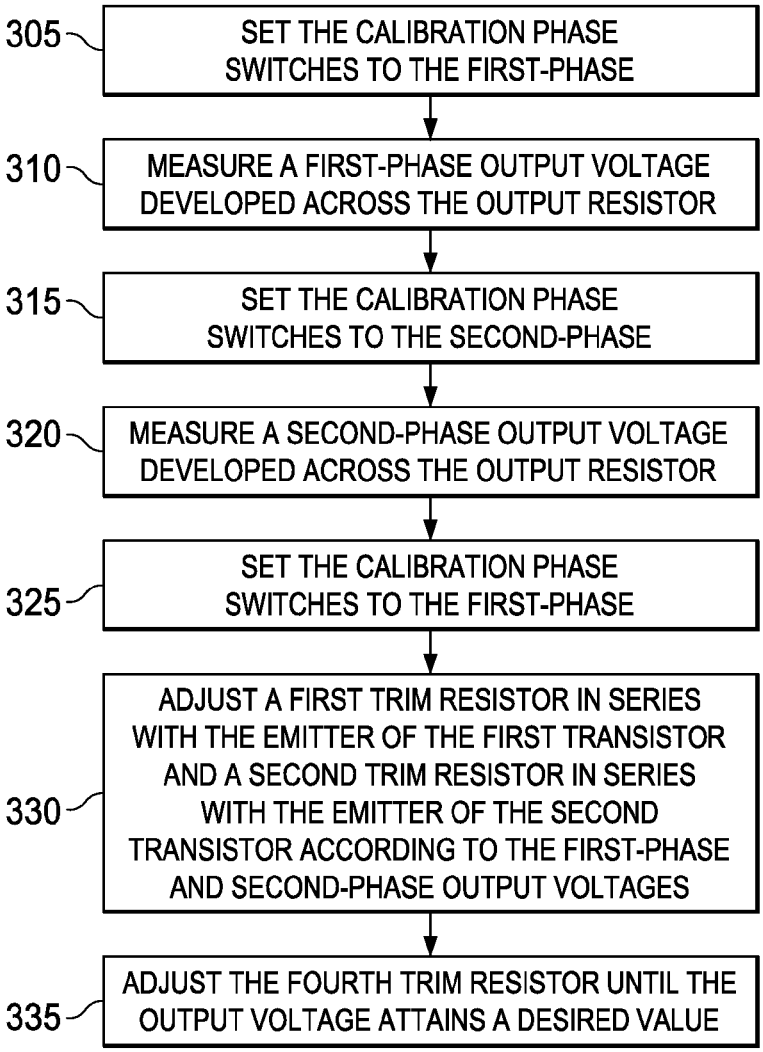
FIG. 3 is a flow-chart illustrating a method for calibrating a bandgap reference voltage source, in accordance with which various embodiments are implemented.

A method for calibrating the bandgap reference voltage source 200 is illustrated in FIG. 3.

At step 305, calibration phase switches are set to a first phase. For example, the phase switches Ph1 among the calibration phase switches are switched on.

A connection is established between the positive amplifier input 209 and the emitter of the first transistor 201, and between the negative amplifier input 211 and the emitter of the second transistor 203.

Further, a connection is established between the positive amplifier output 213 and the first terminal of the fourth trim transistor 231, the second terminal of the third trim resistor 229, and between the negative amplifier output 215 and the common return.

At step 310, a first-phase output voltage developed across the output resistor is measured.

As in equation (2), the first phase output voltage is measured as $V_{OUT1}$=VBGSlope+VOFFSET.

At step 315, the calibration phase switches is set to the second phase. For example, the phase switches Ph2 among the calibration phase switches are switched on after switching Ph1 off.

A connection is established between the positive amplifier input 209 and the emitter of the second transistor 203, and between the negative amplifier input 211 and the emitter of the first transistor 201.

A connection is established between the positive amplifier output 213 and the common return, and between the negative amplifier output 215 and the first terminal of the fourth trim transistor 231, the second terminal of the third trim resistor 229.

At step 320, a second-phase output voltage developed across the output resistor is measured.

As in equation (3), the second phase output voltage is measured as $V_{OUT2}$=VBGSlope−VOFFSET.

At step 325, the calibration phase switches (Ph1) are again set to the first phase.

At step 330, the first trim resistor 225 in series with the emitter of the second transistor 203 and the second trim resistor 227 in series with the emitter of the first transistor 201 are adjusted according to the first-phase and second-phase output voltages measured in step 310 and step 320 respectively.

In an embodiment, the adjusting includes calculating a slope voltage as an average of the first-phase and second-phase output voltages and calculating an offset voltage as one-half the difference between the first-phase and second-phase output voltages, the output voltage being equal to the sum of the slope and offset voltages. The first trim resistor 225 and the second trim resistor 227 are adjusted (trimmed) till a desired output voltage that is equivalent of the summation of the slope voltage and the offset voltage is obtained.

In some embodiments, the adjusting includes calculating a slope voltage as an average of the first-phase and second-phase output voltages and calculating an offset voltage as one-half the difference between the first-phase and second-phase output voltages, the output voltage being equal to the sum of the slope and offset voltages. The output resistor is adjusted first to correct for offset voltages and then the first, the second and the third trim resistors are adjusted till the output voltage is adjusted to the desired value.

In addition, the third trim resistor 229 can also be adjusted.

At step 335, a fourth trim resistor is adjusted until the output voltage attains a desired value.

In an embodiment, the fourth trim resistor is adjusted to make the output voltage equal to the slope voltage.

In some embodiments, after step 320, the calibration phase switches are set to the second phase and the second-phase output voltage developed across the output resistor is measured. Then, the output resistor and the first, second and third trim resistor can be adjusted adjusted till the desired output voltage is obtained.

The bandgap reference voltage source disclosed in present disclosure is able to trim the band-gap at one temperature for slope (resulting from $V_{BE}$ & $\Delta V_{BE}$ errors) and a separate trim for correcting the offset component of the amplifier. It is possible to get high accurate band-gap reference without the cost and time overhead of the second temperature trim. In addition, bandgap reference voltage source disclosed in present disclosure utilizes less space. Further, the transistors utilized in the present disclosure can be an Analog Friendly (AF) transistor or non-AF transistors.

In the foregoing discussion, each of the terms "coupled", "in communication" and "connected" refers to either a direct electrical connection or mechanical connection between the devices connected or an indirect connection through intermediary devices.

The foregoing description sets forth numerous specific details to convey a thorough understanding of embodiments of the disclosure. However, it will be apparent to one skilled in the art that embodiments of the disclosure may be practiced without these specific details. Some well-known features are not described in detail in order to avoid obscuring the disclosure. Other variations and embodiments are possible in light of above teachings, and it is thus intended that the scope of disclosure not be limited by this Detailed Description, but only by the Claims.

What is claimed is:

1. A bandgap reference voltage source comprising:

an output resistor;

first and second transistors having collectors connected to a common return and bases connected to a first terminal of the output resistor;

a differential amplifier having a positive input, a negative input, a positive output and a negative output;

a positive-input calibration phase switch in communication with the positive amplifier input, a emitter of the first transistor, and a emitter of the second transistor;

a negative-input calibration phase switch in communication with the negative amplifier input, the emitter of the first transistor, and the emitter of the second transistor;

a positive-output calibration phase switch in communication with the positive amplifier output, the first terminal of the output resistor, and a second terminal of the output resistor;

a negative-output calibration phase switch in communication with the negative amplifier output, the first terminal of the output resistor, and the second terminal of the output resistor; and an adjustable resistance in communication with the emitter of the first transistor, the emitter of the second transistor, and the second terminal of the output resistor.

2. The voltage source of claim 1 wherein the first and second transistors comprise bipolar PNP transistors.

3. The voltage source of claim 1 wherein the output resistor comprises a variable resistor and a fixed resistor in series, an output being defined at a junction between the variable and fixed resistors.

4. The voltage source of claim 1 wherein the adjustable resistance comprises four trim resistors, first terminals of each of the first three trim resistors connected to a common node, a second terminal of the first trim resistor in communication with the emitter of the first transistor, a second terminal of the second trim resistor in communication with the emitter of the second transistor through a balancing resistor, a second terminal of the third trim resistor connected to a first terminal of the fourth trim resistor, and a second terminal of the fourth trim resistor connected to the second terminal of the output resistor to define an output.

5. The voltage source of claim 1 wherein in a first calibration phase:

the positive-input calibration phase switch establishes a connection between the positive amplifier input and the emitter of the first transistor, the negative-input calibration phase switch establishes a connection between the negative amplifier input and the emitter of the second transistor, the positive-output calibration phase switch establishes a connection between the positive amplifier output and the second terminal of the output resistor, and the negative-output calibration phase switch establishes a connection between the negative amplifier output and the first terminal of the output resistor; and wherein in a second calibration phase:

the positive-input calibration phase switch establishes a connection between the positive amplifier input and the emitter of the second transistor, the negative-input calibration phase switch establishes a connection between the negative amplifier input and the emitter of the first transistor, the positive-output calibration phase switch establishes a connection between the positive amplifier output and the first terminal of the output resistor, and the negative-output calibration phase switch establishes a connection between the negative amplifier output and the second terminal of the output resistor.

6. The voltage source of claim 5 and further comprising the balancing resistor in series with the emitter of the second transistor.

7. The voltage source of claim 1 and further comprising a balancing resistor in series with the emitter of the first transistor.

8. A method of calibrating a bandgap reference voltage source having:

a positive-input calibration phase switch that in a first phase establishes a connection between a positive amplifier input and a emitter of a first transistor and in a second phase establishes a connection between the positive amplifier input and a emitter of a second transistor;

a negative-input calibration phase switch that in the first phase establishes a connection between a negative amplifier input and the emitter of the second transistor and in the second phase establishes a connection between the negative amplifier input and the emitter of the first transistor;

a positive-output calibration phase switch that in the first phase establishes a connection between a positive amplifier output and a second terminal of an output resistor and in the second phase establishes a connection between the positive amplifier output and a first terminal of the output resistor; and a negative-output calibration phase switch that in the first phase establishes a connection between a negative amplifier output and the first terminal of an output resistor and in the second phase establishes a connection between the negative amplifier output and the second terminal of the output resistor, the method comprising:

setting the calibration phase switches to the first phase;

measuring a first-phase output voltage developed across the output resistor;

setting the calibration phase switches to the second phase;

measuring a second-phase output voltage developed across the output resistor;

setting the calibration phase switches to the first phase;

adjusting a first trim resistor in series with the emitter of the first transistor and a second trim resistor in series with the emitter of the second transistor according to the first-phase and second-phase output voltages; and adjusting the output resistor until the output voltage attains a desired value.

9. The method of claim 8 wherein adjusting the first and second trim resistors comprises:

calculating a slope voltage as an average of the first-phase and second-phase output voltages; and calculating an offset voltage as one-half the difference between the first-phase and second-phase output voltages.

10. The method of claim 9 wherein adjusting the first and second trim resistors comprises adjusting the trim resistors to make the output voltage equal to the sum of the slope and offset voltages.

11. The method of claim 8 wherein adjusting the output resistor comprises adjusting the output resistor to make the output voltage equal to the slope voltage.

12. The method of claim 8 wherein adjusting the first and second trim resistors comprises adjusting a third trim resistor having a first terminal connected to the first and second trim resistors and a second terminal connected to the first terminal of the output resistor.

13. The method of claim 8 wherein adjusting the output resistor comprises adjusting a trim resistor in series with a fixed resistor and wherein the output voltage is developed across the fixed resistor.

14. The method of claim 9, and further comprising:

the output resistor is adjusted first to correct for offset voltages; and the first, the second and the third trim resistors are adjusted till the output voltage is adjusted to the desired value.

15. The method of claim 8, wherein for the calibration phase switches set to the second phase and the second-phase output voltage developed across the output resistor, the output resistor and the first, second and third trim resistor are adjusted till the desired output voltage is obtained.

* * * * *